US006858950B1

(12) United States Patent
Simon

(10) Patent No.: US 6,858,950 B1
(45) Date of Patent: Feb. 22, 2005

(54) LIQUID POWER MACHINE

(76) Inventor: Istvan Simon, Rosengässchen 7, 8200 Schaffhausen (CH)

( * ) Notice: Subject to any disclaimer, the term of this patent is extended or adjusted under 35 U.S.C. 154(b) by 110 days.

(21) Appl. No.: 09/136,820

(22) Filed: Aug. 19, 1998

(30) Foreign Application Priority Data

Aug. 22, 1997 (CH) ..... 1968/97

(51) Int. Cl.[7] ..... F03C 1/00
(52) U.S. Cl. ..... 290/1 R; 290/54; 60/495
(58) Field of Search ..... 290/1 R, 54; 60/495, 60/496

(56) References Cited

U.S. PATENT DOCUMENTS 3,927,330 A * 12/1975 Skorupinski ..... 290/54
3,934,964 A * 1/1976 Diamond ..... 415/7
4,034,565 A * 7/1977 McVeigh ..... 60/503
4,112,686 A * 9/1978 Trotta ..... 60/639
4,241,283 A * 12/1980 Storer, Sr. ..... 290/54
4,242,868 A * 1/1981 Smith ..... 60/496
4,253,795 A * 3/1981 McQueen ..... 415/125
4,254,622 A * 3/1981 Denson, Sr. ..... 60/496
4,258,269 A * 3/1981 Tsubota ..... 290/53
4,404,801 A * 9/1983 Palm ..... 60/496
RE31,449 E * 11/1983 Crider ..... 290/43
4,498,294 A * 2/1985 Everett ..... 60/496
4,948,985 A * 8/1990 Adams ..... 290/54
6,009,707 A * 1/2000 Alkhamis ..... 60/398
6,249,057 B1 * 6/2001 Lehet ..... 290/1 R
6,305,165 B1 * 10/2001 Mizuki, Sr. ..... 60/496

FOREIGN PATENT DOCUMENTS

GB 2 269 635 A * 2/1994
WO WO 81/01175 * 4/1981

OTHER PUBLICATIONS

"Perpetual Motion Machines" Scientific American, Jan. 1968, vol. 218, No. 1, NY,NY.*

* cited by examiner

*Primary Examiner*—Nicholas Ponomarenko
(74) *Attorney, Agent, or Firm*—Baghman & LaPointe, P.C.

(57) ABSTRACT

A water power machine comprises a drive means and a drive output means which are interconnected by a lever drive assembly. The drive means comprises a motor operated by downward movement of water, the water being lifted again by a conveyor operated by power taken from the drive means, whereby the water power machine operates with a comparatively small amount of water by virtue of utilising a circulating amount of water.

7 Claims, 11 Drawing Sheets

LIQUID POWER MACHINE

FIELD OF THE INVENTION

The invention concerns a liquid power machine.

For the sake of convenience hereinafter the term water will generally be used to denote the liquid involved in operation of the machine but it will be appreciated that other liquids may be used if appropriate.

BACKGROUND OF THE INVENTION

A water power machine, which may also be referred to hereinafter as the machine for the sake of brevity, makes use of the potential energy or working capacity of flowing and/or falling bodies of water for producing mechanical energy. A flow turbine is an example of using the potential energy of flowing water for producing mechanical energy. A further example is water wheels which, for example with a suitable afflux, convert the potential energy of flowing and falling water into mechanical energy. In that case the energies due to the speed and position or weight of the flowing water are converted. Besides the energies due to speed and position of flowing water, turbines also transform the pressure energies thereof into mechanical energy. A common aspect of those machines is that they are disposed substantially in a flow of water, wherein the water flows to the machines, then flows through the machines with conversion of the energies, in order then to flow away from the machines (this is also referred to as the through-flow technology, for the sake of brevity). This restricts the siting thereof to those locations which involve quantitatively sufficient, naturally or artificially flowing bodies of water, both cases generally requiring expensive water installations for guiding and/or providing a build-up of water.

SUMMARY OF THE INVENTION

An object of the invention is to provide a water power machine whose operating location or site is substantially independent of the presence of naturally or artificially flowing water and which requires less water to produce energy than machines which operate on the basis of the through-flow technology.

A further object of the invention is to provide a liquid power machine which affords recirculation of its operating liquid to minimise its operating liquid supply requirement.

Still another object of the invention is to provide a liquid power machine which is of a simple structure while enjoying a high degree of flexibility and adaptability to varying operational conditions and demands.

In accordance with the invention there is provided a liquid power machine comprising comprising a drive means and a drive output means which are in engagement with each other by way of a lever drive assembly.

It will be seen from the description hereinafter of a preferred embodiment of the machine according to the invention, in contrast to prior machines which operate on the basis of the open through-flow technology, the machine according to the invention operates by means of a substantially closed liquid circuit, the expression substantially closed circuit denoting a circulating amount of liquid in regard to which only quantitative losses are made up, that is to say in accordance with the invention on the basis of a circulatory procedure in which, between two levels of liquid which are arranged one above the other, the energy content of the liquid is used to produce forces which in turn are partially used again to convey the liquid from a lower level (lower energy level) to an upper level (higher energy level) while the forces which are liberated for prescribed purposes are available at the drive output means of the machine according to the invention. That therefore at least contributes to avoiding disadvantages of the prior machines, that is to say a limited choice in regard to siting, a necessarily large supply of water and expensive measures in terms of hydraulic engineering.

Further objects, features and advantages of the invention will be apparent from the following description of a preferred embodiment.

DESCRIPTION OF THE PREFERRED EMBODIMENT

Figure 1:
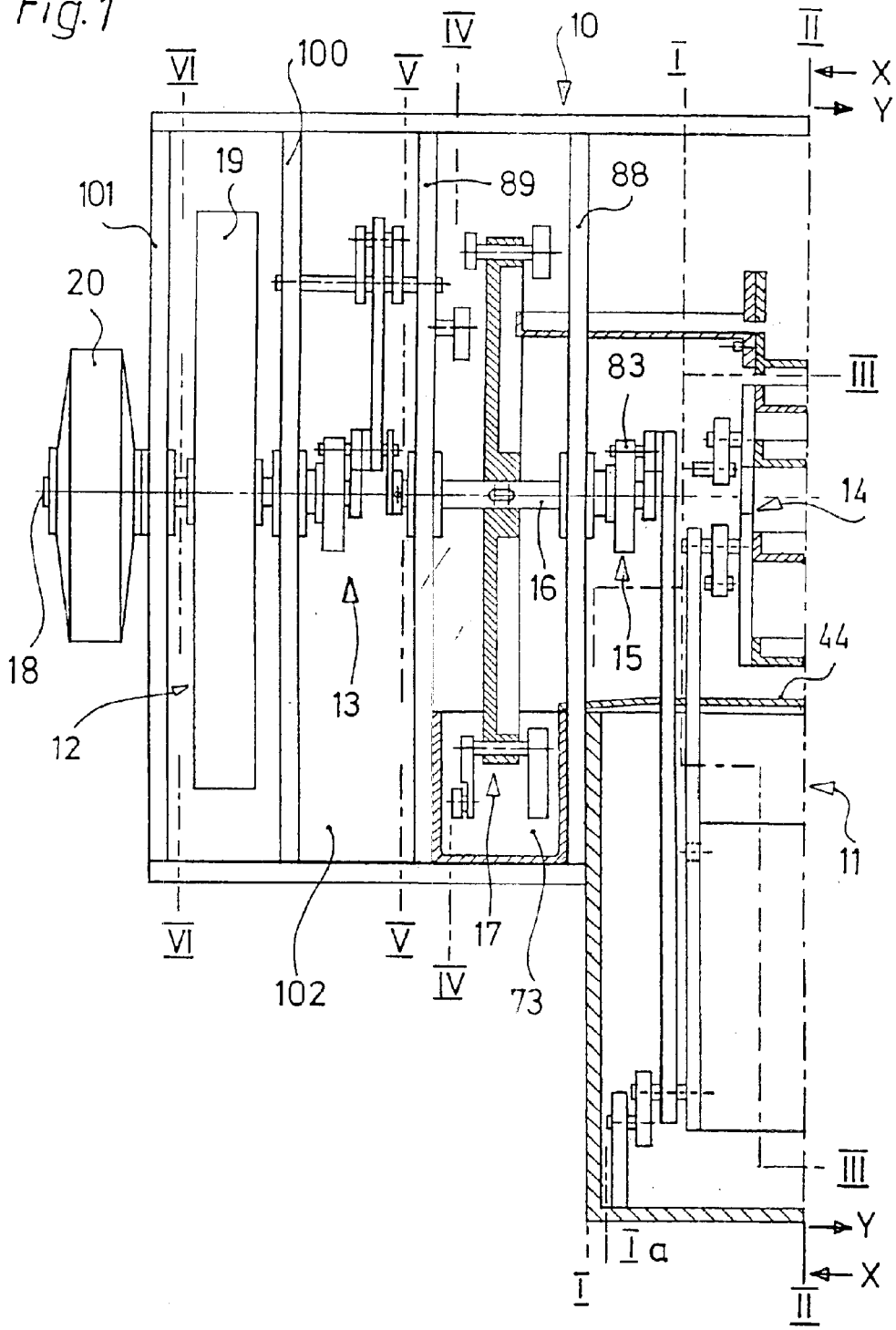
FIG. 1 is a partly sectional overall side view of the machine according to the invention.

Referring to FIG. 1 the machine 10 includes a drive means indicated by reference 11 and a drive output means indicated by reference 12 which can be in engagement with each other by way of a lever drive assembly indicated generally at 13.

The drive means 11 substantially comprises a prime mover in the form of a hydraulic motor 14 (hereinafter referred to as the motor 14 for the sake of brevity) which is in engagement by way of a direction converter 15 with a first shaft 16 which in turn carries a wheel 90 of a conveyor arrangement 17. The drive output means 12 is substantially a second shaft 18 which as illustrated carries a flywheel 19 and which drives for example a current generator 20.

Figure 4:
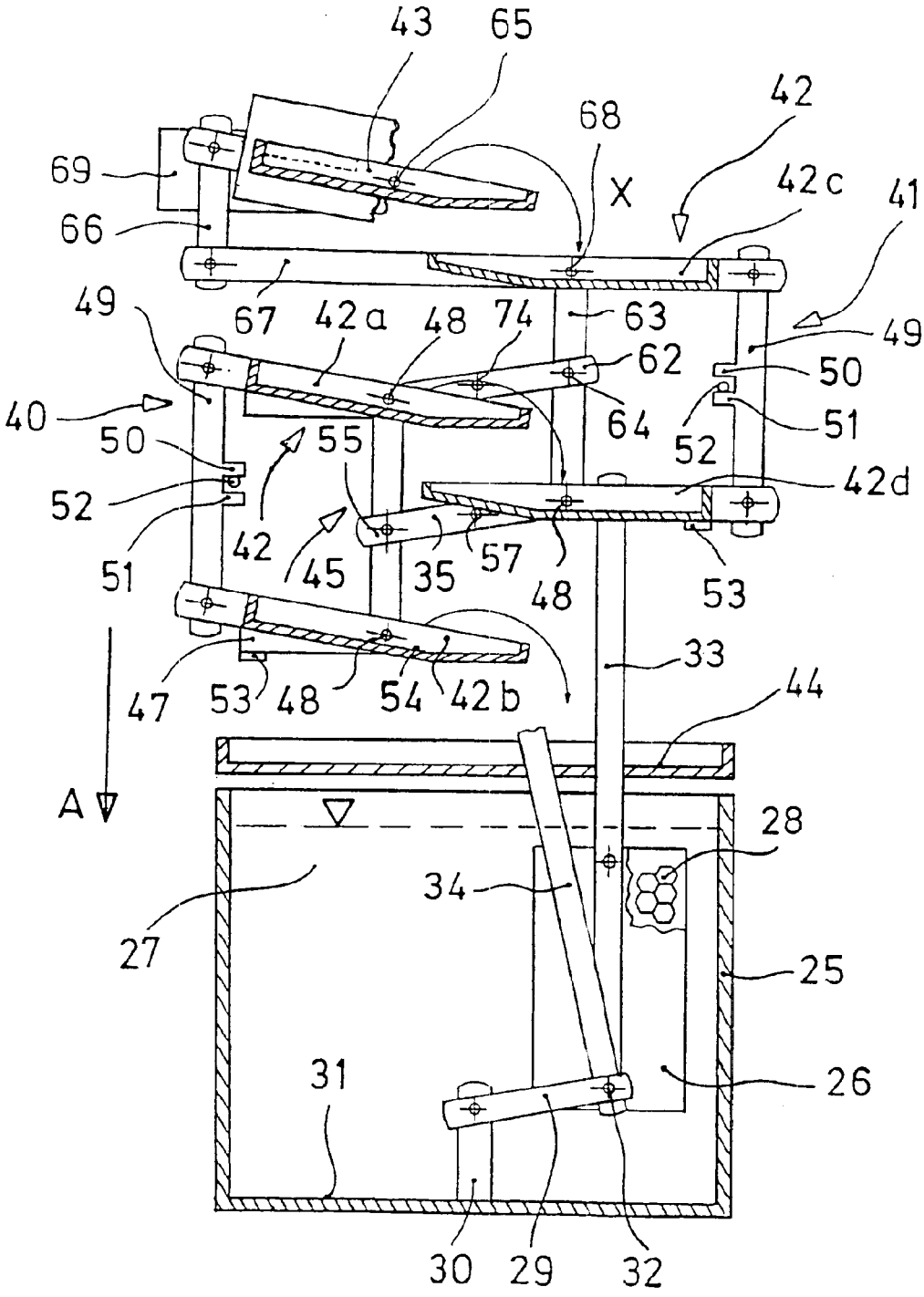
FIG. 4 shows the part of the drive means illustrated in FIG. 3 along section line II—II as a front view, viewing in the direction of the arrow X, with a cascade assembly of the drive means moving downwardly in the direction A.

Referring to FIG. 4 showing a front view of the motor 14, the motor 14 comprises a liquid container 25 in which a buoyancy or float body 26 is accommodated, being immersed in a liquid 27 such as water and guided therein in such a way that it can move up and down. The float body 26 is a closed hollow body which, for reinforcement thereof, encloses a core 28 of honeycomb configuration, which fills up its hollow internal volume. The float body 26 is held in guided relationship in the liquid container 25 at one end by a pivotal lever 29. For that purpose the pivotal lever 29 is pivotably mounted at a first end to a support 30 which in turn is connected for example to the bottom 31 of the liquid container 25, while at the second end the pivotal lever 29 is arranged pivotably on the float body 26. At its second front end the pivotal lever 29 carries a connecting pin or bolt 32 pivotably connecting the pivotal lever 29 to the float body 26, at a spacing. Between the pivotal lever 29 and the float body 26, the connecting pin or bolt 32 carries a thrust bar or rod 33 and a connecting rod 34.

Figure 2:
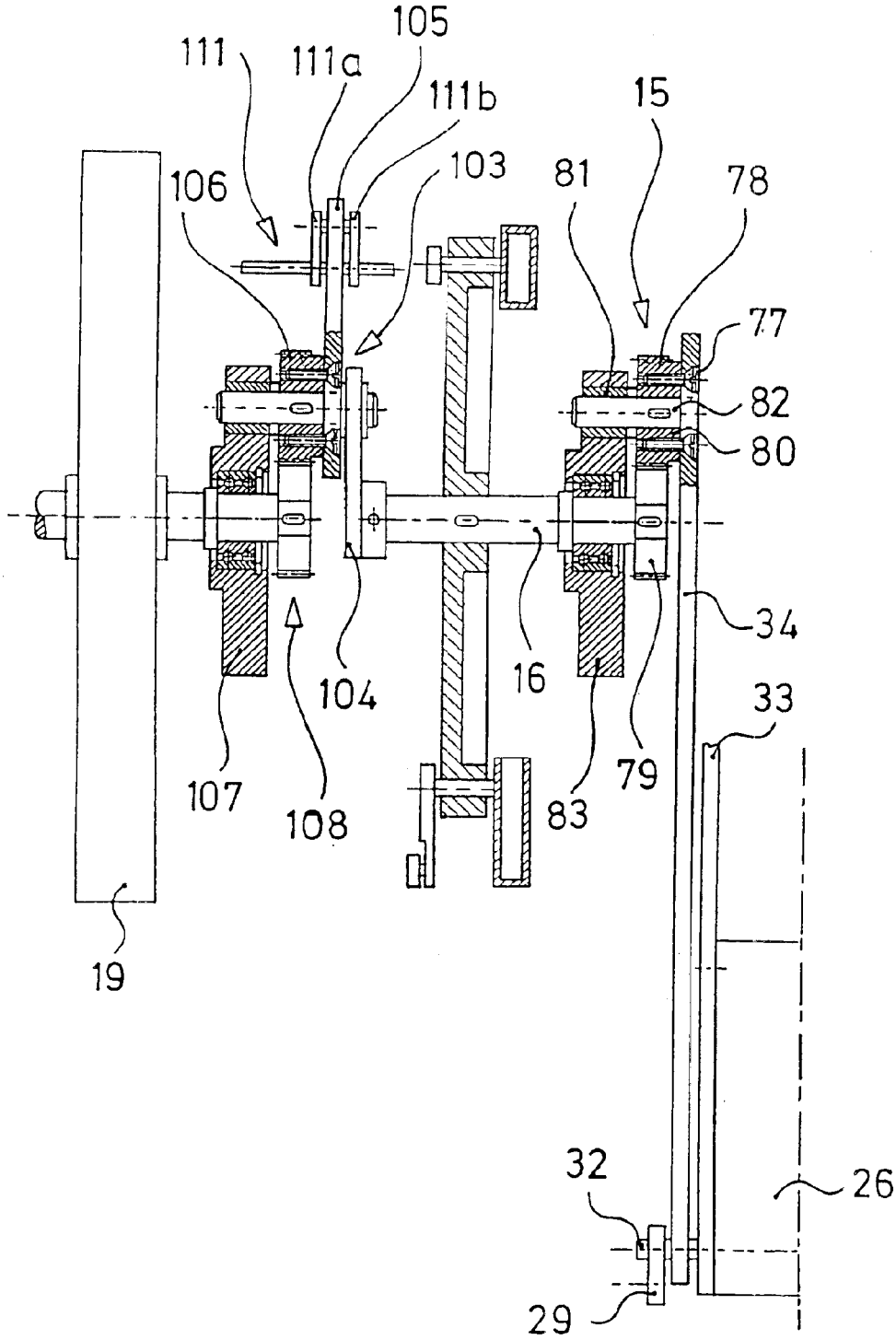
FIG. 2 is a partly sectional side view of a part of the structure shown in FIG. 1, the partial view being limited at one end by the section lines I and Ia and at the other end by the section line VI—VI in FIG. 1.

FIG. 2 shows the connecting rod 34 in engagement with the direction converter 15 and FIG. 4 shows the thrust rod 33 in engagement with a control lever 35, actuating cascade assemblies 40, 41.

FIG. 4 shows two cascade assemblies which are positively guided in their opposite directions of movement, being the cascade part of the motor 14, namely a left-hand cascade assembly 41 and a right-hand cascade assembly 41, whose stages indicated generally at 42 (referred to hereinafter as pivotal containers 42) partially engage one into the other at a spacing from each other in a vertical direction and thus form a stepped fall of liquid, preferably water, between an upper feed container 43 and a lower liquid level (flow-receiving bottom 44, referred to for brevity as the bottom 44).

Figure 5:
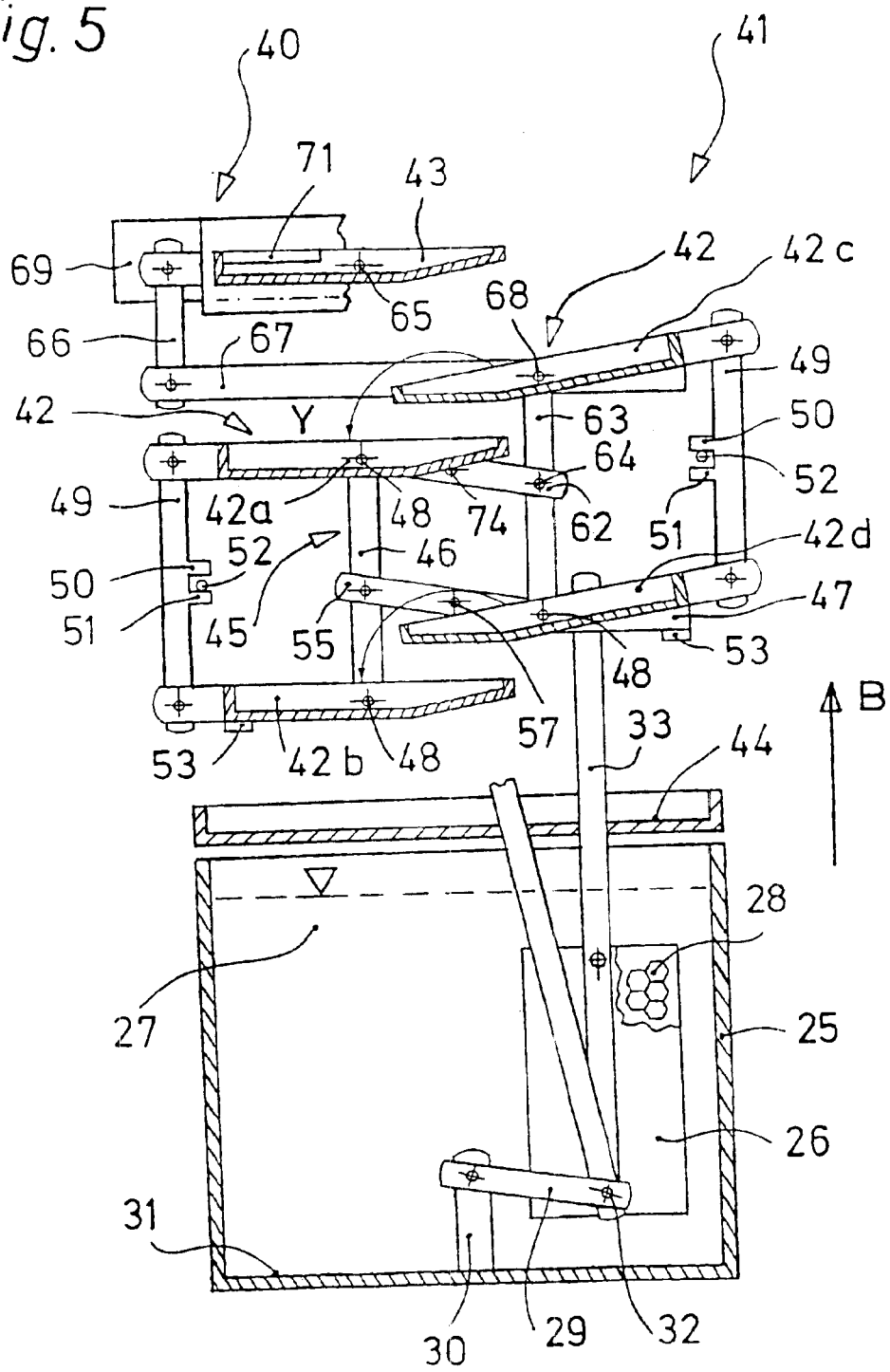
FIG. 5 shows the part of the drive means illustrated in FIG. 4, with a cascade assembly of the drive means moving upwardly in the direction B.

The left-hand cascade assembly 40 includes the feed container 43 and two pivotal containers 42*a*, 42*b* and the right-hand cascade assembly 41 includes two pivotal containers 42*c*. 42*d*. The pivotal containers 42*a*, 42*b* of the left-hand cascade assembly 40 are pivotably connected to a carrier device 45 which in vertical section is in the form of a double-T-bearer. The carrier device 45 as such includes, as shown in FIG. 5, a web 46 and two equal-length limbs 47 which extend at a right angle to the web 46 and which each project in respect of half thereof from the web 46. Arranged at the transitions between the web 46 and the limbs 47 are carriers 48 to which the pivotal containers 42 (42*a* at the top and 42*b* at the bottom) are pivotably secured. The pivotal containers 42 are of a trough-shaped configuration, they are open upwardly at the carrier device 45, that is to say they are open in the flow direction indicated by the arrow X in FIG. 4, and they are mounted at the centre pivotably about the carriers 48.

The pivotal movements of the pivotal containers 42*a* and 42*b* are synchronised by a connecting member 49 to which the ends that are disposed in opposite relationship to the downstream ends of the pivotal containers 42*a*, 42*b* are pivotably mounted. The vertical spacing of the pivotal connections of the pivotal containers 42*a*, 42*b* to the connecting member 49 corresponds to the vertical spacing of the carriers 48 at the carrier device 45 so that the pivotal containers 42*a*, 42*b* pivot at an equal angle relative to the horizontal, that is to say always in mutually parallel relationship. The extent of the pivotal movement is determined by a control device including two abutments 50, 51 which are arranged on the connecting member 49 at a given vertical spacing and an abutment 52 which is arranged between the abutments 50, 51 and which is stationary in contrast to the abutments 50, 51 which are vertically movable with the connecting member 49. The control device further includes a carrier 53 which projects at a right angle from the end of the limb 47 that is towards the connecting member 49, and which can be brought into engagement with the bottom 54 of the pivotal container 42*b*. The front free end 55 of the control lever 35 is pivotably mounted to the web 46 centrally thereon, while the free rear end 56 of the control lever 35 is pivotably arranged on the thrust rod 33. Reference 57 denotes a stationary mounting arrangement at which the control lever 35 is centrally and pivotably arranged, stationary always meaning fixedly mounted to the machine housing structure or the like support component.

The left-hand cascade assembly 40 includes two pivotal containers 42*a*, 42*b* and the feed container 43. The pivotal containers 42*c*, 42*d* are likewise pivotably mounted to a carrier device as described hereinbefore with reference to the left-hand cascade assembly 40. The connecting member and the control device are also identical to the left-hand cascade assembly 40. A lever 62 connects the upper carrier 48 of the left-hand cascade assembly 40 to the middle of the web 63 of the carrier device of the right-hand cascade assembly 41, insofar as it is there pivotably connected to a bearing 64. Like the control lever 35 the lever 62 also pivots about a stationary bearing 74. The pivotal connection of the lever 62 to the left-hand cascade assembly 40 and the right-hand cascade assembly 41 is such that the control lever 35 and the lever 62 extend in mutually parallel relationship. The right-hand cascade assembly 41 also produces the pivotal movement of the feed container 43. To produce the pivotal movement, the feed container 43 is arranged centrally on a stationary bearing or mounting 65 pivotably about same. A connecting link 66 is connected at one end to the side of the feed container 43 which is remote from the discharge end thereof while the other end of the connecting link 66 is connected to a control rod 67 which in turn is connected to the upper bearing 68 of the right-hand cascade assembly.

Figure 3:
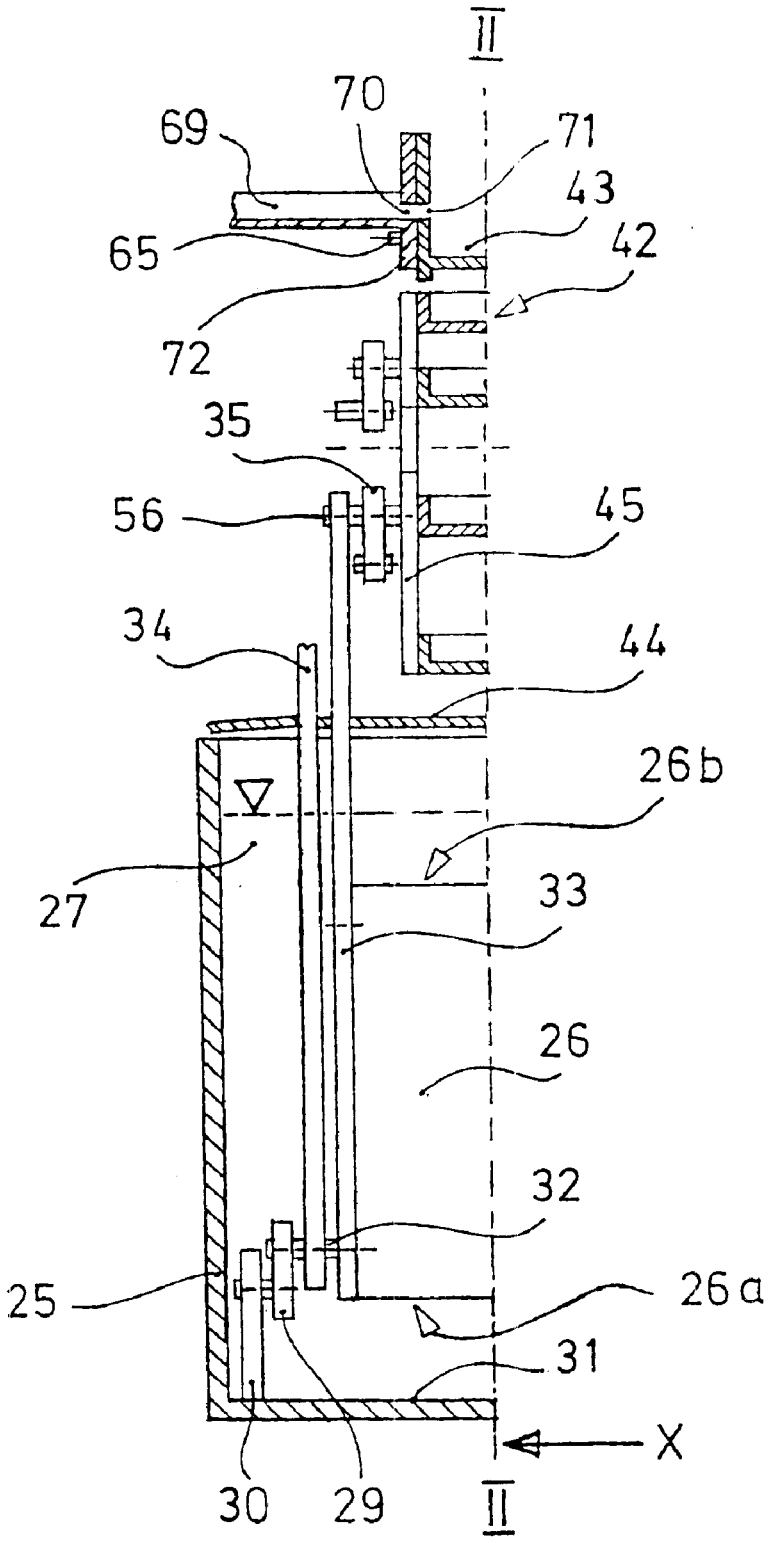
FIG. 3 is a partially sectional side view of a detail from the structure shown in FIG. 1, limited at one end by the section line II—II and at the other end by the section line I/Ia, showing part of a drive means in simplified form.

FIG. 3 shows an upper liquid container 69 which intermittently feeds liquid into the feed container 43. For that purpose the upper liquid container 69 and the feed container 43 have through-flow openings 70 (in the upper liquid container 69) and 71 (in the feed container 43) which are alternately opened and closed. Opening and closing of the opening 70 is effected by a side wall 72 of the feed container 43 insofar as, upon pivotal movement of the feed container 43, the opening 71 is moved out of the illustrated position, in a manner corresponding to the pivotal movement, and the opening 70 is closed by the side wall 72. Reference 44 denotes a bottom which, as shown in FIG. 4, at one end extends entirely beneath the left-hand cascade assembly 40 and the right-hand cascade assembly 41 and at the other end, as shown in FIG. 1, discharges into a lower liquid container 73. Hereinbefore the left-hand cascade assembly 40 and the right-hand cascade assembly 41 were described with two pivotal containers 42, and two pivotal containers 42 and a feed container 43 respectively. The apparatus according to the invention however is not limited to that number of containers, and each cascade assembly, with suitable adaptation of the carrier arrangements and the like, may also have more containers than described, in which case however each cascade assembly must have the same number of containers, namely a cascade assembly and in addition a feed container.

Converting the substantially upwardly and downwardly directed movement of the thrust rod 33 into a rotary movement is the function of the motion direction converter, referred to for the sake of brevity as the direction converter or further abbreviated to converter 15.

Figure 8:
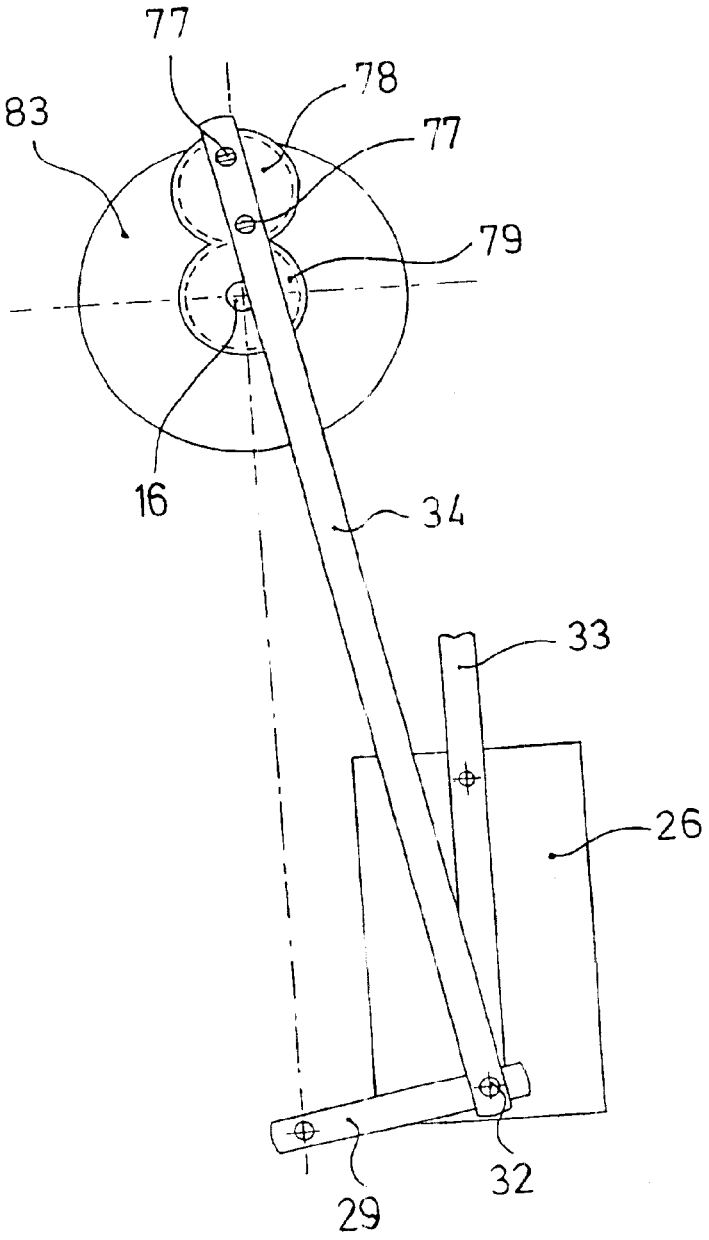
FIG. 8 is a diagrammatic view of a direction converter co-operating with a buoyancy body, as a front view, in section along section line III—III in FIG. 1.

As shown in FIGS. 2 and 8 the converter 15 includes a driving toothed gear 78, referred to hereinafter for the sake of brevity as the drive gear 78, and a driven toothed gear 79, referred to hereinafter for the sake of brevity as the driven gear 79. On both sides the drive gear 78 which itself is not rotatable is carried in fixed relationship on a shaft 82 between two bearings 80, 81 which move synchronously and over the same circular orbital paths. The radius of the circular orbital paths is determined from the sum of the radii of the drive gear 78 and the driven gear 79. The drive gear 75 is mounted on the one side (fixed bearing 80) at the free front end of the connecting rod 34 and on the other side at a mounting disc 83 (bearing 81) by means of the shaft 82. The shaft 82 with the drive gear 78 which is mounted thereon fixedly, that is to say non-rotatably, is non-rotatably accommodated in the bearing 80 while the shaft 82 is capable of rotating in the bearing 81 in the disc 83 and in the bearing at the front or upper end of the connecting rod 34. The drive gear 78 is fixedly connected to the connecting rod 34 by way of a screw means 77. The driven gear 79 is fixedly connected to the end of the first shaft 16, said end being towards the connecting rod 34. The disc 83 is itself freely rotatably arranged on the first shaft 16. The ratio between the number of teeth on the driven gear 79 and the drive gear 78 is preferably 1:1.

Figure 10:
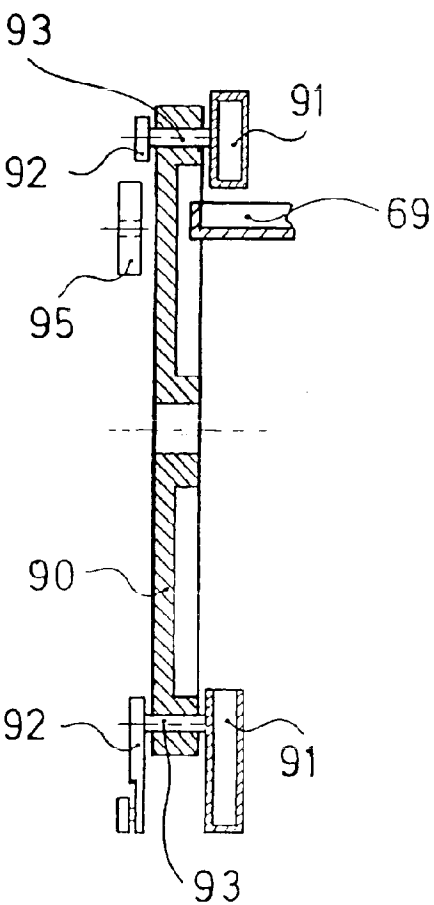
FIG. 10 is a sectional side view of the conveyor arrangement shown in FIG. 9.
Figure 9:
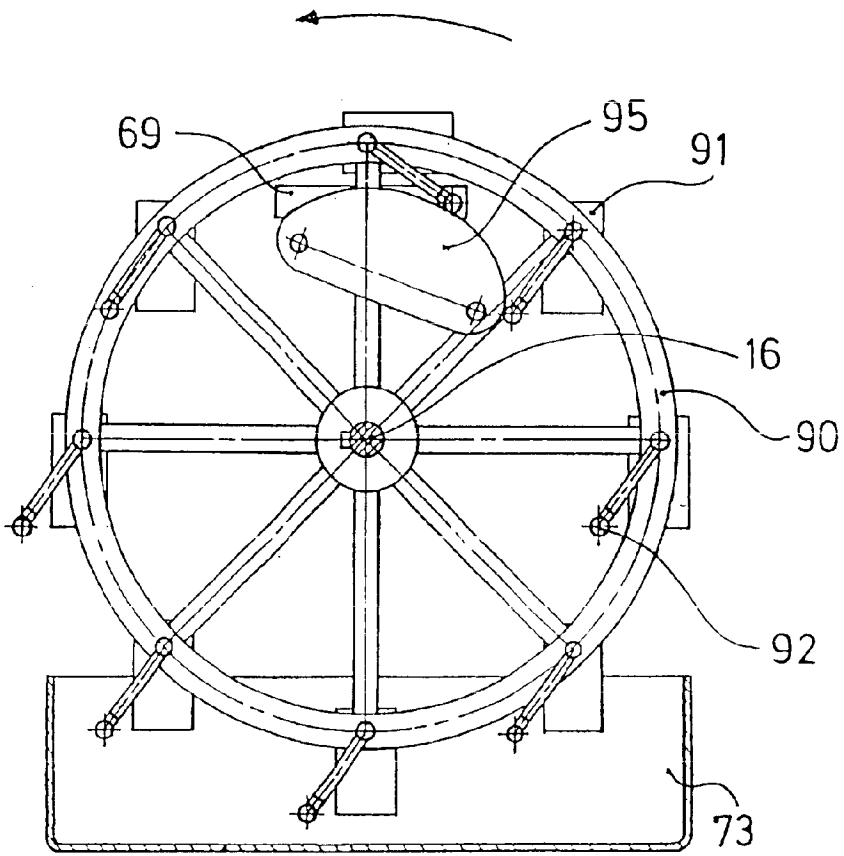
FIG. 9 is a diagrammatic view of a conveyor arrangement in section along section line IV—IV in FIG. 1 as a front view, in the direction indicated by the arrow Y in FIG. 1.

The first shaft 16, rotatably mounted at two upright support embers 88, 89 (see FIG. 1), carries the conveyor arrangement 17, following the disc 83 in the axial direction. As shown in FIGS. 9 and 10 the conveyor arrangement 17 comprises a wheel 90 which is fixedly connected to the first shaft 16, that is to say which is non-rotatatably arranged on the first shaft 16. On its face and in the proximity of its outer periphery the wheel 90 carries containers 91 which are arranged pivotably on the wheel 90. A control lever 92 co-operates with each container 91, of which for example there are provided eight uniformly distributed at the periphery of the wheel. The containers 91 and the control levers 92 are each fixedly connected to each other by way of a respective pin 93 engaging through the wheel 90 from one face to the other so that the container 91 follows a pivotal movement of the control lever 92. The conveyor arrangement 17 transports a liquid medium, for example water, from a lower supply or storage container 73 (lower level) into the upper liquid container 69 (upper level). Provided in the proximity of the upper liquid container 69 is a control plate 95 on to which the control levers 92 run so that they and the containers 91 are pivoted thereby.

Figure 11:
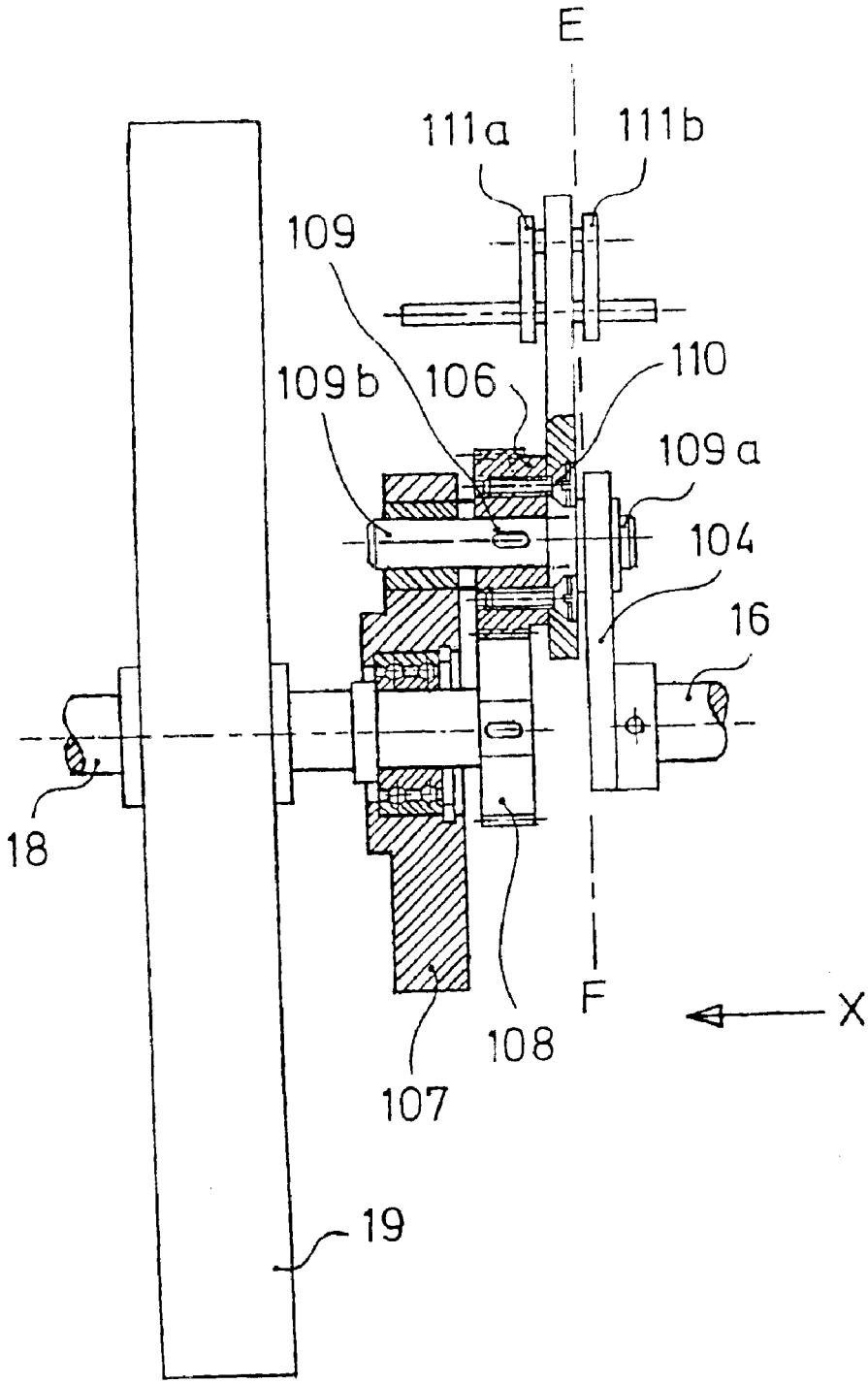
FIG. 11 shows a shaft connector, connecting two shafts which occur in succession in the axial direction, and a flywheel arranged on a shaft, as a side view, with the illustration being limited at one end by the section line V—V in FIG. 1 and at the other end by the section line. VI—VI, with the shaft connector being partly in section.

FIGS. 1, 2 and 11 show that the drive means 11 and the drive output means 12 are in engagement with each other by way of a lever drive assembly 13. The lever drive assembly 13 connects the first driving shaft 16 of the drive means 11 to the second driven shaft 18 of the drive output means 12, which would be separate from each other, without the arrangement, that is to say the interposition, of the lever drive assembly 13. Hereinafter the terms 'drive side' and 'driven side' are used in connection with ends of the shaft. In that respect the drive-side shaft end denotes the shaft end which extends towards or is directed in the direction of the motor 14 while the driven-side shaft end denotes the shaft end which extends towards or is directed in the direction of the current generator 20.

As FIG. 1 shows the second shaft 18, that is to say the shaft 18 of the drive output means 12, is mounted between two upright support members 100 and 101 of the apparatus 10 according to the invention in axial alignment with respect to the first shaft 16 of the drive means 11. The spacing between the support members 89 and 100 affords an intermediate space 102 in which the lever drive assembly 13 is accommodated.

Referring to FIG. 2, the lever drive assembly 13 includes a driving portion 103 comprising a drive lever 104 fixedly arranged at the driven-side end of the shaft 16, a carrier arm 105 with a driver 106 arranged fixedly, that is to say non-rotatably, at its free front end, a mounting disc 107 which in turn is freely rotatably arranged on the shaft 18, and a driven portion 108, in the present case a rotary body 108, which is fixedly connectedly arranged on the drive-side end of the shaft 18, followed on the driven side by the mounting disc 107. In the present case the driver 106 and the rotary body 108 are in the form of interengaging gears with a gear tooth ratio of 1:1, but they may also be different from gears, provided that they are such that they can roll around each other while being in engagement with each other.

The drive lever 104 is at one end fixedly arranged on the driven-side end of the shaft 16. At the other end, that is to say at its free end, it carries a shaft trunnion or journal 109 (FIG. 11) whose drive-side end 109*a* is rotatably accommodated in the drive lever 104. The journal 109 rotatably passes through the carrier arm 105 and, following the carrier arm 105, carries the driver 106 which is non-rotatably mounted on the journal 109. The driver 106 is fixedly connected to the carrier arm 105 by a screw means 110, with the face of the driver 106 bearing against the driven-side surface of the carrier arm 105. As indicated above, that kind of arrangement is also to be found in the fixing of the gear 78 to the thrust rod 34. The free end 109*b* of the journal 109, following the driver 106, is rotatably accommodated in the mounting disc 107. Therefore the journal 109 is rotatably accommodated at both sides, on the one hand in the drive lever 104 (drive side) and on the other hand in the mounting disc 107 (driven side).

Figure 12:
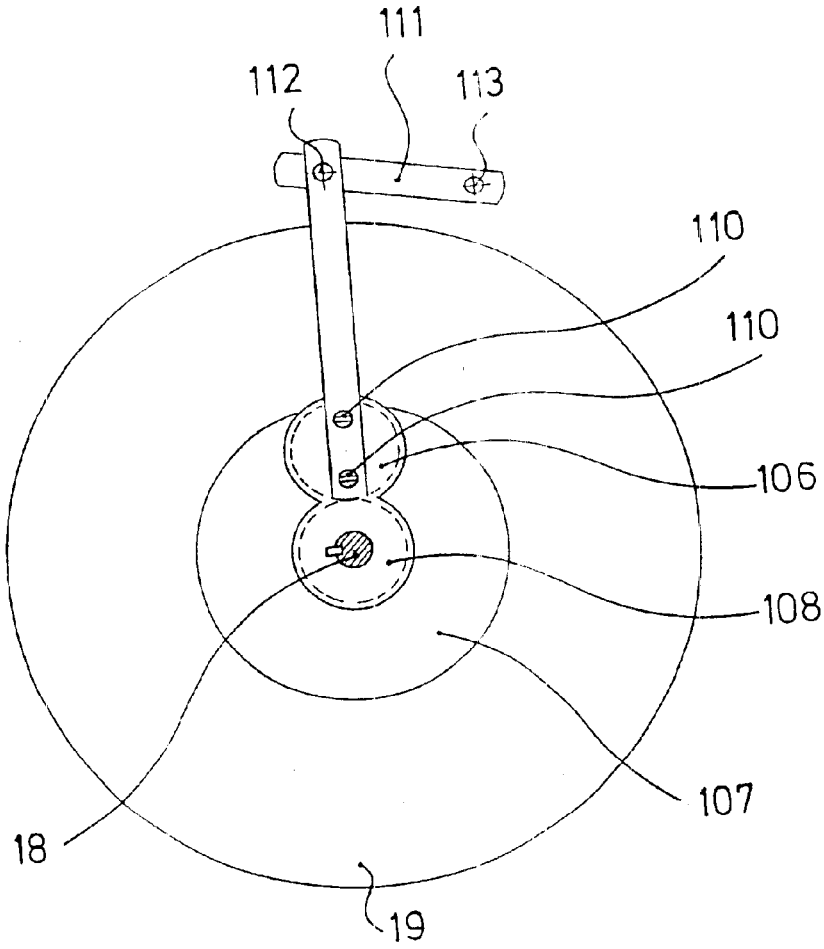
FIG. 12 shows the shaft connector of FIG. 11 as a front view, that is to say in FIG. 11 along the section line E–F and viewing in the direction of the arrow X in FIG. 1.

At the other and of the carrier arm 105, being the end which is opposite to the driver 106, the carrier arm 105 is pivotably connected to a front free end of a carrier lever 111 whose other end is pivotably arranged on a carrier device indicated at 112 in FIG. 12.

The carrier lever 111 is formed from two lever arms 11*a* and 111*b* which are held in parallel spaced relationship and between which the carrier arm 105 is pivotably mounted by means of a pivot bearing indicated at 113 in FIG. 12. The carrier device 112 is for example a carrier of circular cross-section, held on both sides by the support members 100 and 89. Therefore the carrier arm 105 is supported on both sides, at one end on the journal 109 and at the other end at the free end of the carrier lever 111, with the carrier lever 111 being pivotably mounted at its other end to the carrier device 112.

Figure 7:
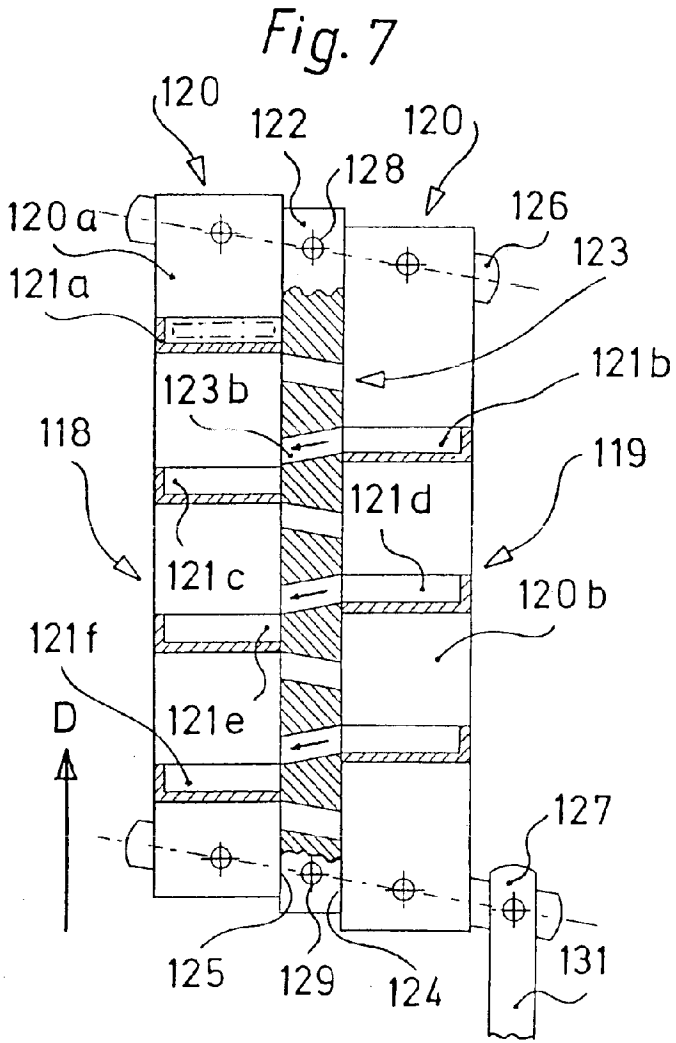
FIG. 7 shows the hydraulic motor illustrated in FIG. 6, a cascade assembly moving upwardly in the direction D.
Figure 6:
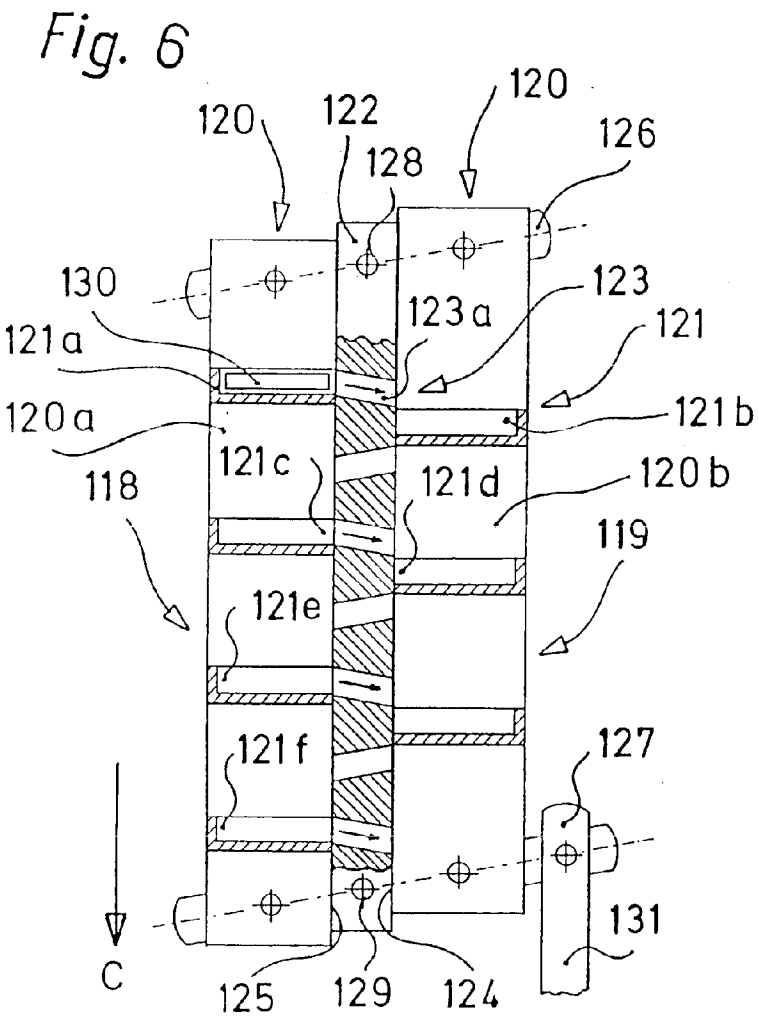
FIG. 6 is a diagrammatic front view of another hydraulic motor (not shown in FIG. 1), a cascade assembly of the motor moving downwardly in the direction C.

FIGS. 6 and 7 show another embodiment of the cascade portion of a motor 14. The cascade portion comprises a left-hand cascade assembly 118 and a right-hand cascade assembly 119. Each cascade assembly has a container carrier indicated generally at 120, on which containers 121 are fixedly arranged at a spacing one above the other for receiving liquid. Disposed between the container carriers 120 is a stationary body 122 through which inclinedly extending passages or ducts 123 pass.

The container carriers 120 (left-hand container carrier 120*a*, right-hand container carrier 120*b*) are pivotably mounted to the body 122 in such a way that they are displaceable up and down, in a condition of bearing against vertical slide walls 124, 125. The container carriers 120 are connected together by way of an upper pivotal lever 126 and a lower pivotal lever 127, both being pivotably connected at their centre to the body 122 by means of pivot mountings 128, 129 so that the cascade assemblies 118, 119 are movable in opposite directions to each other. The containers 121 are open on their top side and at the side which adjoins the slide walls 124, 125, that is to say, the slide walls 124, 125 replace the missing side wall for each respective container 121. FIG. 6 shows a feed flow means 130 which co-operates with the uppermost container 121*a* of the left-hand cascade assembly 118 and which is intermittently opened and closed by said container 121*a*. FIGS. 6 and 7 show the inclinations of the passages or ducts 123. The passage 123*a*, starting from the left-hand cascade assembly 118, is inclined in a direction towards the right-hand cascade assembly 119, while the passage 123*b*, starting from the right-hand cascade assembly 119, is inclined in a direction towards the left-hand cascade assembly 118. That alternate arrangement is continued at respective uniform spacings over the heightwise extent of the body 112. The containers 121 are arranged in mutually displaced relationship in a vertical direction on the container carriers 120*a* and 120*b*, with the dimension of the displacement of the containers corresponding to a container height dimension.

Referring to FIG. 6, liquid issuing from the feed flow means 130 passes into the container 121*a* of the left-hand cascade assembly 118, from there by way of the passage 123*a* into the container 121*b* of the right-hand cascade assembly 119. Due to the weight of the liquid in the container 121*b* of the right-hand cascade assembly 119, it is moved downwardly in the direction indicated by the arrow C in FIG. 6 while the left-hand cascade assembly 118 rises in the direction indicated by the arrow D in FIG. 7, with the uppermost container 121*a* closing off the flow through the feed flow means 130. The liquid then flows out of the container 121*b*, passing through the passage communicating with the container 121*b*, into the container 121*c* in the left-hand cascade assembly 118, which causes the left-hand cascade assembly 118 to move downwardly, with the feed flow means 130 being opened. In that position of the container carriers 120 the container 121*b* is again filled with liquid, coming from the container 121*a*, while the container 121*c* is emptying into the container 121*d*. Due to that change in weight from the left-hand cascade assembly 118 to the right-hand cascade assembly 119, the latter again moves downwardly (FIG. 7), wherein, in the lower downwardly moved position the container 121*b* empties into the container 121*c* and the container 121*d* into the container 121*e*, which in turn produces a downward movement of the left-hand cascade assembly 118. Filling and emptying of the containers 121 continues with the upward and downward movement of the cascade assemblies, until the amount of liquid filling the container 121*f* is discharged therefrom by way of the lowermost passage 123. When all containers 121 of the left-hand cascade assembly 118 and the right-hand cascade assembly 119 are filled, the weight difference necessary for the upward and downward movement of the cascade assemblies is afforded by overfilling of a cascade assembly in relation to the other, or a reduction in the weight of a cascade assembly by sudden partial emptying. The upward and downward movement of the container carriers 120 produces at the lower pivotal lever 127*a* pivotal movement thereof about the lower pivot mounting 129, and that movement can be transmitted by the pivotal lever 127 to a connecting rod 131 in engagement with a direction converter.

The mode of operation of the apparatus 10 according to the invention is as follows:

The motor 14 produces a substantially rectilinear, upwardly and downwardly directed movement, comparable to the free end of a connecting rod connected to the piston of an internal combustion engine. By means of the direction converter 15, that movement is converted into a rotary movement which is transmitted to the shaft 16, with the direction converter 15 being comparable to the crank throw of a crankshaft of an internal combustion engine, the end of which performs a rotary movement, like the shaft 16. With the shaft 16, the wheel 90 of the conveyor arrangement 17, which is fixedly mounted thereon, also rotates. The lever drive assembly 13 arranged between the individual shafts 16 and 17 takes off the rotary movement of the shaft 16 and transmits it to the shaft 18.

The substantially rectilinear, upwardly and downwardly directed movement of the thrust rod 33 is produced by the float body 26, which is immersed in the liquid 27 in the liquid container, for example water, being loaded or relieved of load. Upon relief of load, the operative buoyancy forces acting on the float body 26 cause the latter to rise in the upward direction (direction indicated by the arrow B in FIG. 5) while when a load is applied it sinks in the downward direction (direction indicated by the arrow A in FIG. 4). Loading and unloading of the float body 26 are effected by the cascade assemblies as indicated for example at 41 and 42 in FIG. 4 which are connected by way of the control lever 35 to the thrust rod 33 and thus to the float body 26 and which move upwardly and downwardly synchronously in opposite relationship in a vertical direction by way of the above-described lever system, in dependence on the varying individual loading weights of the cascade assemblies, which occur due to the loading and unloading of the pivotal containers such as 42 which are positively controlled in terms of their movements. If for example the wheel 90 of the conveyor arrangement 17 rotates in the counter-clockwise direction, as indicated by the arrow in FIG. 9, then loading and unloading of the cascade assemblies 40, 41 occurs repetitively in the same sequence as follows. When the free end of the thrust rod 33, that is to say the upper end which is connected to the control lever 35, has reached its uppermost reversal point (see the position in FIG. 4) then the pivotal containers 42*c* and 42*d* are horizontal and the feed container 43 which is equally associated with the right-hand cascade assembly 41 is pivoted in a direction towards the pivotal containers of the right-hand cascade assembly 41. The containers 42*a* and 42*b* of the left-hand cascade assembly 40 are pivoted in the same direction as and extend parallel to the feed container 43. In that reversal position, a container 42*d* of the right-hand cascade assembly 41 rests on the carrier 53 while the static abutment 52, co-operating with the right-hand cascade assembly 41, bears against the vertically displaceable abutment 51 of the right-hand cascade assembly 41 and the corresponding abutment 52 of the left-hand cascade assembly 40 bears against the abutment 50, the latter being disposed in opposite relationship to the former. The pivotal container 42*b* of the left-hand cascade assembly 40, which corresponds to the pivotal container 42*d* of the right-hand cascade assembly 41, is lifted by the abutment 52 of the left-hand cascade assembly 40. In that reversal position the pivotal container 42*c* is filled from the feed container 43 and the pivotal container 42*d* is filled from the pivotal container 42*a* while the pivotal container 42*b* is discharged towards the bottom 44'. Loaded by the weight of the cascade assemblies 40, 41, that weight consisting of the weights of the cascade assemblies 40, 41 themselves, the weight of the lever mechanism and the feed container 43 and the weight of the liquid loads in the pivotal containers 42*c*, 42*d*, the thrust rod 33 moves in a direction towards its lower reversal point as indicated by the arrow A in FIG. 4, referred to hereinafter as the downward movement, with simultaneous downwardly directed displacement of the position of the float body 26. During the downward movement the right-hand cascade assembly 41 with the feed container 43, due to the pivotal mounting of the cascade assembly 41 to the control lever 35 and the lever 62, moves downwardly in substantially the same direction as the thrust rod 33, until the abutment 50 bears against the static abutment 52. When the abutment 52 comes into contact with the abutment 50, the downward movement of the right-hand cascade assembly 41 with the feed container 43 continues, but the connecting member 49 no longer follows the downward movement and now causes pivotal movement of the containers 42*c*, 42*d* on the carrier arrangement 45*a* of the right-hand cascade assembly 41 in a direction towards the left-hand cascade assembly 40, while the feed container 43 is moved out of its position of inclination in a direction towards the right-hand cascade assembly 41, into a horizontal position. While the right-hand cascade assembly 41 with feed container 43 follows the downward movement of the thrust rod 33, the left-hand cascade assembly 40 rises synchronously in the opposite direction, that is to say upwardly. During the upward movement the abutment 51 comes to bear against the abutment 52, which likewise with continuing upward movement of the left-hand cascade assembly 40 produces pivotal movement of the containers 42*a* and 42*b* from a position of being pivoted towards the right-hand cascade assembly 41 into the horizontal position. When the pivotal movement into the horizontal position has taken place, for example the bottom or the underside 6*f* the container 42*b* rests on the carrier 53. The carriers 53, one of which is provided for each pivotal container, perform the function of holding the respective pivotal containers 42 in the horizontal position while the stationary abutment 52 changes its condition of engagement with the displaceable abutments 50, 51. When the thrust rod 33 reaches the lower reversal point shown in FIG. 5, then the containers 42 of the right-hand cascade assembly 41 are pivoted to such an extent that the content thereof can flow over into the horizontally disposed containers 42 of the left-hand cascade assembly 40 while the feed container 43 is loaded from the upper liquid container 69.

FIG. 4 shows the position of the cascade assemblies 40, 41 and the pivotal position of the containers 42 at the upper reversal point in the movement of the thrust rod 33 directly before initiation of the downward movement while FIG. 5 shows the positions of the cascade assemblies and the pivotal positions at the lower reversal point immediately before initiation of the upward movement of the thrust rod 33. During the upward movement the movements of the cascade assemblies 40, 41 take place in the reverse sequence to that described above in connection with the downward movement.

In accordance with the invention the buoyancy force F of the float body 26 is used for operation of the apparatus 10. The buoyancy force is determined from the difference of the forces which act on the lower surface indicated at 26*a* in FIG. 3 and the upper surface at 26*b* in FIG. 3 of the float body 26. As the force acting on the lower surface 26*a* is greater than the force acting on the upper surface 26*b*, then, so that the float body 26 moves downwardly, the force which acts downwardly on the float body 26 by way of the thrust rod 33 and which results from the weight of the two cascade assemblies such as 40, 41 with lever mechanisms and the weights afforded by the loads of liquid in the containers 42 must be at least slightly greater than the buoyancy force, while the force which acts on the float body 26 in the upward movement should be at least slightly less than the buoyancy force. In accordance with the invention, that difference can be set by a procedure whereby at the upper reversal point the pivotal containers 42 of the right-hand cascade assembly 41 are overfilled to produce the necessary weight while at the lower reversal point one or more pivotal containers 42 of the left-hand cascade assembly 40 are preferably suddenly relieved of the load of the weight of the overfilling plus the reduction in weight necessary for the float body 26 to rise.

Pivotably connected to the float body 26 is the connecting rod 34 which connects the float body 26 to the direction converter 15 which transforms the substantially vertically upwardly and downwardly directed movement of the float body 26 or the thrust rod 33 into a rotary movement for transmission to the first shaft 16. As mentioned above and as shown for example in FIGS. 4 and 5, at their free ends towards the tank or liquid container 25, the thrust rod 33 and the connecting rod 34 are pivotably connected to the lower end of the float body 26 at the connecting pin or bolt 32 to which one end of the pivotal lever 29 is also pivotably connected, wherein the other end of the pivotal lever 29 is pivotably arranged at the bottom 31 of the liquid container 25. In that way, in the upward and downward movement of the float body 26 which is guided in the liquid container 25 by way of the pivotal lever 29, the thrust rod 33 and the connecting rod 34 can synchronously follow the float body 26. The connecting rod 34 moves between an upper reversal point and a lower reversal point, the spacing of which from each other is determined by the diameter of the driven gear 79 and half the diameter of the drive gear 78 as can be clearly seen from FIG. 8.

That also defines the distance that the float body 26, immersed in the liquid 27, covers in the upward and downward movement thereof in each revolution of the shaft 16.

The mode of operation of the direction converter 15 is as follows, with reference to FIGS. 2 and 8:

The drive gear 78 which is fixedly arranged at the end of the connecting rod 34 has the shaft 82 engaging therethrough; the shaft 82 in turn is carried at one end fixedly, that is to say, non-rotatably, on the connecting rod 34, but at the other end it is carried rotatably in the mounting disc 83. The disc 83 in turn is freely rotatably mounted on the shaft 16. The drive gear 78 which is supported at both sides but which itself does not rotate can thus circle around the shaft 16 on a circular path. In order to convert that movement into a rotary movement, the drive gear 78 is in engagement with the driven gear 79 by way of external tooth arrangements on the respective gears, with the driven gear 79 being fixedly carried on the shaft 16. With the adopted ratio between the number of teeth of the drive and driven gears 78, 79 of preferably 1:1, the shaft 16 rotates twice about itself for a revolution of 360° of the drive gear 78 about the driven gear 79.

The conveyor arrangement 17 conveys liquid from a lower liquid container at 73 in FIG. 1 into an upper liquid container at 69 in FIGS. 3, 4 and 5 and lifts the liquid which has previously passed through the motor 14, giving off portions of its energy at it did so, to a higher energy level again. The liquid discharging from the motor 14 flows to the lower liquid container 73 over the bottom 44. The lower liquid container 73 stores an amount of liquid which is greater than the amount of liquid which is in the work-performing liquid circuit of the machine 10 according to the invention, this being for reasons of rapid complete filling of the containers 91 which pass through the liquid container 73 on a circular path and which, pivotably mounted to the wheel 90, convey liquid into the upper liquid container 69 insofar as, due to the control levers 92 passing on to the control plate, the containers 91 are caused to pivot over the upper liquid container 69 in such a way that the liquid contained in the containers 91 is discharged. The amount of liquid which flows through the substantially closed circuit is also determined in accordance with the amount of liquid which, from the upper liquid container 69, flows through the cascade assemblies 40, 41, flows over the bottom 44 to the lower liquid container 73, is removed therefrom by means of the containers 91 carried by the wheel 90, and is conveyed again into the upper liquid container 69, that amount of liquid for operation of the apparatus remaining substantially constant. With the adopted ratio of the number of teeth as between the drive gear 78 and the driven gear 79 of 1:1, involving the same number of teeth and equal outside diameters, the conveyor wheel 9 rotates twice like the shaft 16 with a complete 360°—revolution of the drive gear 78 about the driven gear 79.

Looking again at FIGS. 2 and 12, the lever drive assembly 13 connects the drive means 11 to the drive output means 12 by virtue of the lever drive assembly 13 transmitting the rotary movement of the first shaft 16 of the drive means 11 to the shaft 18 of the drive output means 12. The drive output lever 104 which is fixedly connected to the driven-side end of the shaft 16, upon rotation thereof, causes the journal 109 (that is to say its axial central line) with the driver 106 fitted thereon to rotate on a circular path, the diameter of which is determined by double the spacing between the longitudinal axis of the shaft 16 and the longitudinal axis of the journal 109. The driver 106 rolls over that circular path with its outer periphery against the outer periphery of the rotary body 108 fixedly arranged on the shaft 18, and thus causes rotation of the rotary body 168 and therewith the shaft 18. The free front end of the carrier lever 105 follows the rotational movement of the journal 109 while the other end of the carrier arm 105 causes the carrier lever 111 to perform pivotal movements, with the carrier lever 111 pivoting about the carrier device 113. It will be clear from the foregoing that the only function of the carrier arm 105 is to hold the driver 106 in such a way that, without rotating itself, it can pass around the rotary body 108 for transmission of the rotary movement of the shaft 16 to the shaft 18. If the ratio between the number of teeth as between the driver 106 and the rotary body 108 is for example 1:1, then, in a complete revolution of the driver 106 around the rotary body 108, the shaft 18 rotates twice, that is to say the speed of rotation of the shaft 16 is doubled by the lever assembly 13'.

Figure 13:
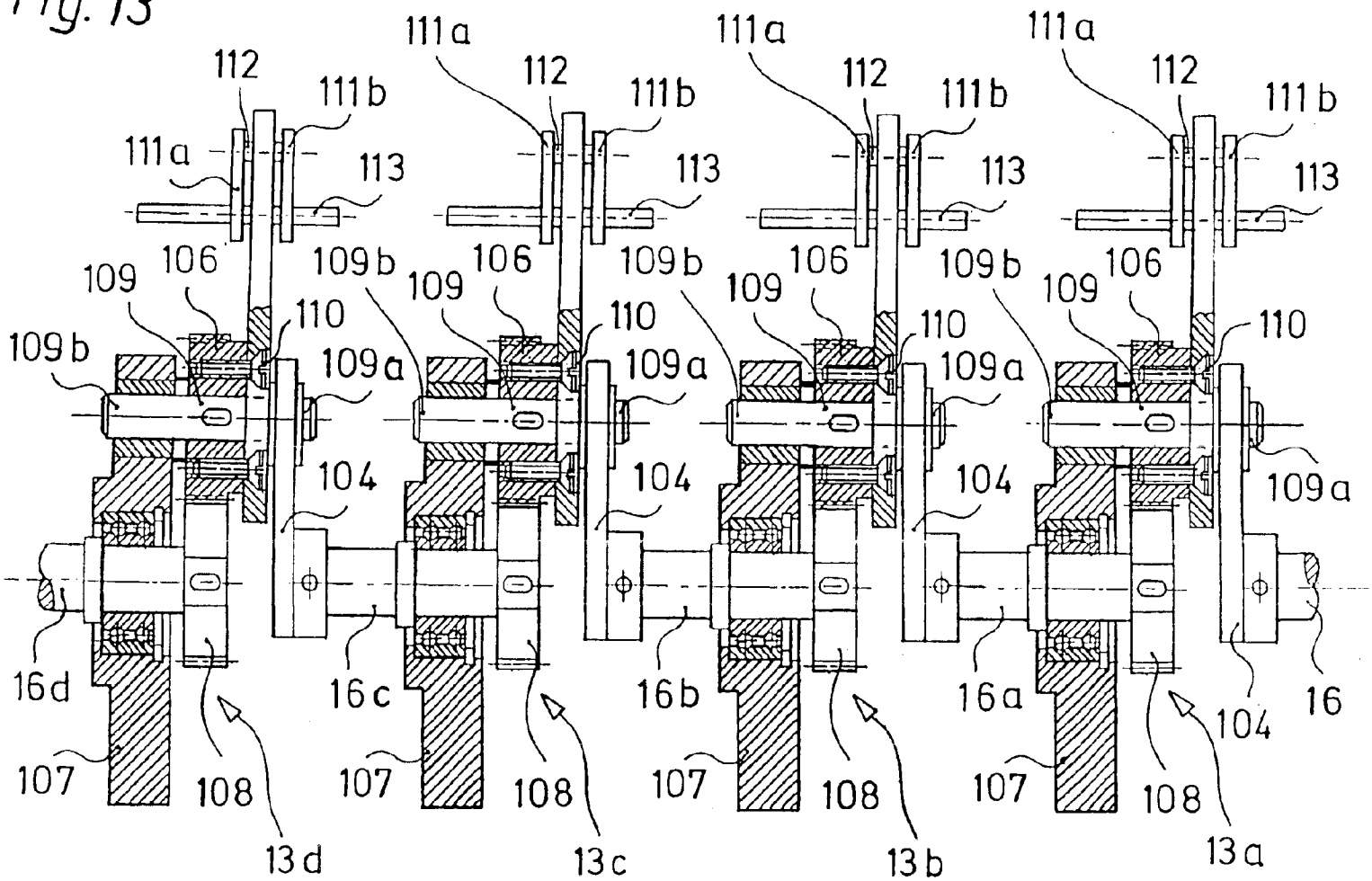
FIG. 13 shows a rotary transmission including for example five successive shafts in engagement with each other by means of four lever drive assemblies.

While FIG. 1 shows a single lever drive assembly 13 between the drive means 11 and the drive output means 12, a train of such lever drive assemblies 13 can be arranged between the drive means 11 and the drive output means 12. By way of example FIG. 13 shows a train 13 comprising a plurality of lever drive assemblies 13, of which four are illustrated here, which are arranged in axial succession. The lever drive assembly 13*a* is driven by for example the shaft 16 of the drive means 12. The lever drive assembly 13*a* transmits the rotary movement of the shaft 16 to the shaft 16*a* on which the lever drive-assembly 13*a* is carried, that shaft 16*a* transmitting its rotary movement by way of the following lever drive assembly 13*b* to the shaft 16*b*, with that design configuration being continued for example twice more in regard to the lever drive assemblies 13*c* and 13*d* and the shafts 16*c* and 16*d*. If 16 is the shaft of a drive means, then 16*d* could be the shaft of the drive output means 12.

A train as shown in FIG. 13 increases, that is to say, multiplies the input speeds of rotation from one stage (lever drive assembly) to another as follows. The ratio in respect of the number of teeth is the ratio of the teeth on the rotary body 108 relative to the number of teeth on the driver 106. As examples: a ratio in regard to the number of teeth of 1:1 means that at its periphery the rotary body 108 carries an equal number of teeth of identical configuration, to the driver 106. A ratio in regard to the number of teeth of 1:2 means that the driver 106 carries twice as many teeth of the same geometrical configuration as the rotary body 108.

If the driver 106 moves around the rotary body 108—with a ratio in regard to the number of teeth of 1:1—then that results in two revolutions of a shaft connected to the rotary body 108 (referred to hereinafter as the rotary body shaft). If the ratio in regard to the number of teeth is 1:2, then with the driver 106 passing once around the rotary body 108, the rotary body shaft rotates three times, while with a ratio of 1:3 it rotates four times. If lever driver assemblies 13 which involve identical tooth ratios are arranged in succession, that means that a revolution of the shaft of the preceding lever drive assembly causes the driver 106 to pass completely around the rotary body 108 of the next following lever drive assembly, which in turn involves two revolutions of the shaft of the following lever drive assembly. Two revolutions of the shaft of the preceding lever drive assembly are thus increased to four revolutions of the shaft of the subsequent lever drive assembly, that is to say they are doubled to four times, and that continues from one stage to another.

The following Table sets out an overview in respect of speeds of rotation in dependence on given ratios in regard to numbers of teeth and the number of stages at the drive-output end of the last downstream-disposed stage if at the first stage a driver passes around a rotary body once per unit of time, for example per second, completely, that is to say through 360°.

| Ratio of number of teeth | Number of lever drive assemblies | Speed $sec^{-1}$ of the last drive lever assembly |
|---|---|---|
| 1:1 | 1 | 2 |
| | 2 | 4 |
| | 3 | 8 |
| | 4 | 16 |
| | 5 | 32 |
| | 6 | 64 |
| | 7 | 128 |
| | 8 | 256 |
| | 9 | 512 |
| | 10 | 1024 |
| 1:2 | 1 | 3 |
| | 2 | 9 |
| | 3 | 27 |
| | 4 | 81 |
| | 5 | 243 |
| | 6 | 729 |
| | 7 | 2187 |
| | 8 | 6561 |
| | 9 | 19683 |
| | 10 | 59049 |

-continued

| Ratio of number of teeth | Number of lever drive assemblies | Speed $sec^{-1}$ of the last drive lever assembly |
|---|---|---|
| 1:3 | 1 | 4 |
| | 2 | 16 |
| | 3 | 64 |
| | 4 | 256 |
| | 5 | 1024 |
| | 6 | 4096 |
| | 7 | 16384 |
| | 8 | 65536 |
| | 9 | 262144 |
| | 10 | 1048576 |

What is claimed is:

1. An hydraulic motor comprising:

a liquid container for containing a liquid with a buoyancy body accommodated in the liquid container and immersed in the liquid therein, first and second cascade assemblies which are positively guided in their opposite directions of movement and which are connected to the buoyancy body by way of a thrust rod, an upper liquid container for conveying liquid to the cascade assemblies and a lower liquid container for the discharge of liquid from the cascade assemblies, and a connecting rod which is movably connected to the buoyancy body and which is in operative engagement with the direction converter.

2. A motor according to claim 1, wherein the buoyancy body includes a core of honeycomb configuration.

3. A motor according to claim 1 or claim 2, wherein the buoyancy body is held in guided relationship in the liquid container by way of a support and a pivotal lever.

4. A motor according to claim 1, wherein the first cascade assembly and the second cascade assembly each have pivotal containers which are arranged at a vertical spacing from each other and in mutually partially interengaging relationship on a carrier device.

5. A motor according to claim 1, wherein the first cascade assembly has a feed container with which a through-flow opening of the upper liquid container is adapted to be intermittently opened and closed.

6. A motor according to claim 3, wherein the first cascade assembly and the second cascade assembly each have pivotal containers which are arranged at a vertical spacing from each other and in mutually partially interengaging relationship on a carrier device.

7. A motor to claim 4, wherein the first cascade assembly has a feed container with which a through-flow opening of the upper liquid container is adapted to be intermittently opened and closed.

* * * * *